United States Patent [19]

Baugh et al.

[11] 4,441,560

[45] Apr. 10, 1984

[54] SETTING TOOL

[75] Inventors: John L. Baugh; James W. Montgomery, both of Huntsville, Tex.

[73] Assignee: Hughes Tool Company, Houston, Tex.

[21] Appl. No.: 494,587

[22] Filed: May 13, 1983

[51] Int. Cl.[3] ..... E21B 23/02

[52] U.S. Cl. ..... 166/382; 166/237; 166/124

[58] Field of Search ..... 166/382, 387, 237, 123–125, 166/181–182, 207, 208

[56] References Cited

U.S. PATENT DOCUMENTS

| | | | |
|---|---|---|---|
| 3,136,367 | 6/1964 | Wright et al. | 166/124 |
| 3,171,491 | 3/1965 | States | 166/208 |
| 3,207,222 | 9/1965 | Tamplen | 166/237 |
| 3,391,742 | 7/1968 | Davis | 166/139 |
| 3,608,634 | 9/1971 | Cochran | 166/208 |
| 3,920,075 | 11/1975 | Braddick et al. | 166/290 |
| 3,934,652 | 1/1976 | Cochran | 166/283 |
| 3,991,826 | 11/1976 | Baugh | 166/120 |

*Primary Examiner*—Ernest R. Purser
*Assistant Examiner*—Thuy M. Bui
*Attorney, Agent, or Firm*—Robert A. Felsman; Charles D. Gunter, Jr.

[57] ABSTRACT

A setting tool is shown of the type adapted to be made up in a pipe string for releasably engaging a setting sleeve in a well bore. The setting tool has a mandrel having an upper end adapted to be connected in the pipe string and having a lower end. A setting nut is carried on the mandrel having external connecting threads for engaging mating connecting threads located on the interior of a setting sleeve disposed about the lower end of the mandrel. The mandrel is slidably disposed within the setting nut when the setting nut is engaging the setting sleeve and the mandrel is slidable between an extended running-in position and a weight set-down position.

A latch collar having at least one latch ear is carried on the mandrel exterior. The setting sleeve has at least one end notch adapted to receive the latch ear for preventing relative rotational movement between the connecting threads of the setting nut and the setting sleeve when the mandrel is in the extended running-in position and allowing relative movement between the connecting threads when the mandrel is in the weigh-down position to release the connecting threads. Torque override is provided for releasing the latch mechanism upon the application of a predetermined rotational torque to the mandrel to thereby allow relative rotational movement between the connecting threads without the application of downward force to the mandrel. The mandrel is spring biased in the extended running-in position and connected by a shear mechanism to the setting sleeve to prevent inadvertent release of the tool during the running in operations.

12 Claims, 6 Drawing Figures

19
11
17
21
23
37
33
31
35
39
49
43
41
45
47

55
51
53
121
123
127
119
125
101
113
107
117
115
97
111
109
79
105
75
103
99
77
III
85
III
91
89
63
61
57
59
81
71
65
67
69
13
25
27
29

FIG. 3
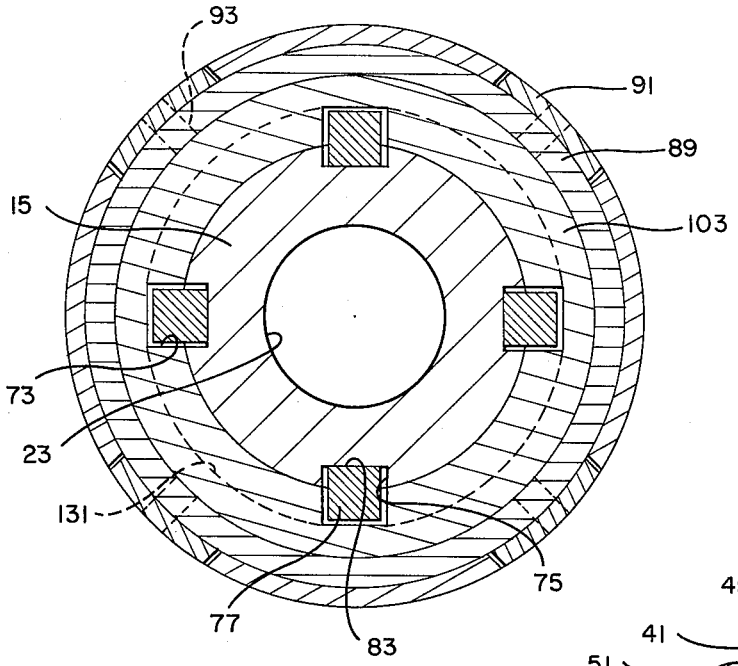
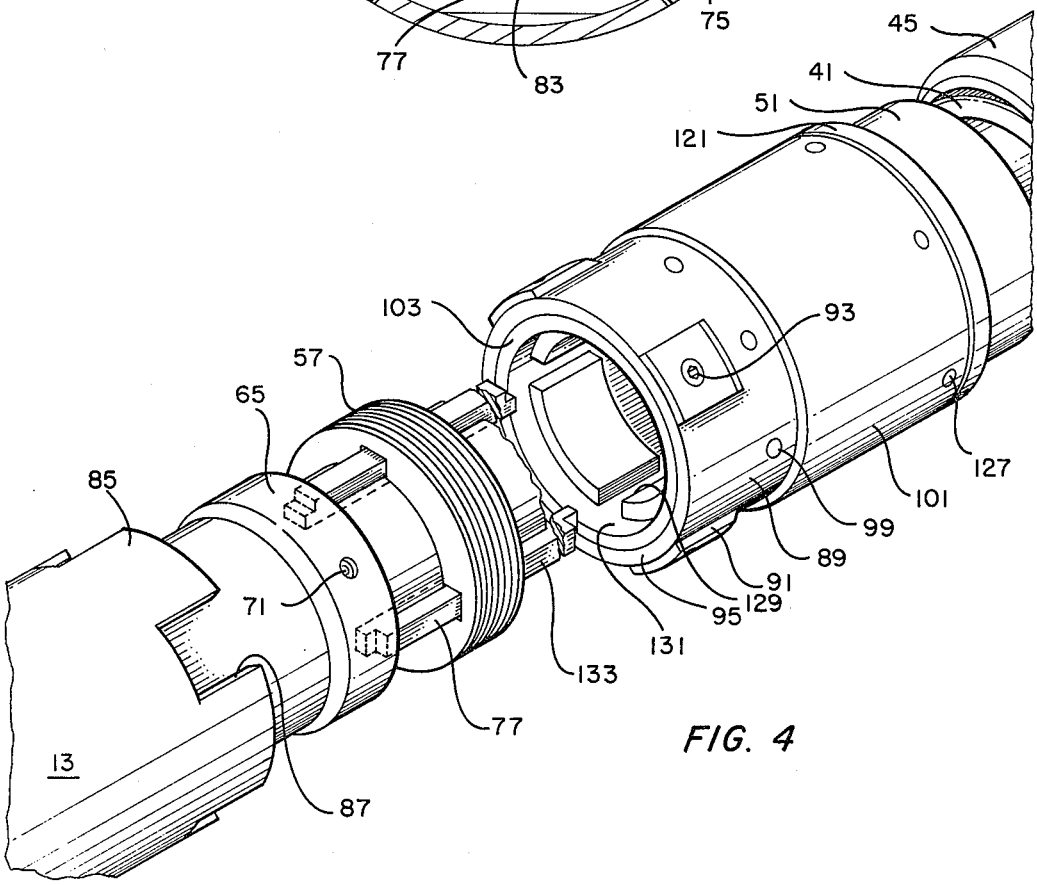
FIG. 4

SETTING TOOL

BACKGROUND OF THE INVENTION

The present invention is related to the co-pending application of John Lindley Baugh and Melvin J. Hardy entitled "SETTING TOOL", filed July 6, 1982, Ser. No. 395,211.

The present invention relates generally to oil well setting tools of the type adapted for engaging a setting sleeve run on a pipe string into a well bore, and specifically to a setting tool which allows right hand torque to be used during well bore operations as well as right hand torque to release the setting tool from the setting sleeve.

Setting tools are used for various purposes during well drilling and completion operations. For instance, a setting tool is typically used during setting of a liner hanger in a well bore. The setting tool is made up in the pipe string between the liner hanger and the pipe string running to the well surface. The setting tool serves as a link to transmit torque to the liner hanger to hang the liner in the well bore. The setting tool is then typically manipulated from the well surface to effect a release of the setting tool from the liner hanger and the liner is then cemented into place in the well bore.

In a typical well drilling pipe string, the lengths of pipe are connected by tool joints with right hand threads which are released by left hand torque. Drilling is thus carried out by clockwise rotation of the drill string to avoid breaking out the tool joints making up the pipe string. In certain setting tool designs, connecting threads were used to engage the setting tool with the setting sleeve which were releasable by right hand torque on the pipe string from the surface. However, this necessitated holding left hand torque on the pipe string while running into the well bore and dictated that the liner be set to the left in order to avoid releasing the setting tool connecting threads. Because left hand torque was used to set the liner, the possibility existed that tool joints in the pipe string would be unscrewed and a joint broken out.

It is, therefore, preferred to utilize a setting tool which allows the liner to be set by applying right hand torque from the surface and which allows the setting tool to be released and pulled out of the well bore by applying a similar right hand torque. There exists a need, therefore, for a setting tool which will allow right hand torque to be used during setting of a liner hanger or similar tool which also allows right hand torque to be used to release the tool.

A need exists for such a setting tool which has a premature release feature which maintains the tool in a locked, running-in position until a predetermined load is placed on the tool to effect release of the tool.

A need also exists for such a tool which has a torque override feature which allows a predetermined torque load to override the locking mechanism to allow the setting tool to be released without applying a load to effect vertical motion of the tool within the well bore.

A need also exists for a tool which is preloaded in the locked position at all times in order to lessen the possibility of inadvertent release.

SUMMARY OF THE INVENTION

The present setting tool of the type adapted to be made up in a pipe string for releasably engaging a setting sleeve in a well bore has a mandrel having an upper end adapted to be connected in the pipe string and a lower end. A setting nut carried on the mandrel has external connecting threads for engaging mating connecting threads located on the interior of a setting sleeve disposed about the lower end of the mandrel. The setting nut has at least one axial groove in the interior thereof. The mandrel is slidably disposed within the setting nut when the setting nut is engaging the setting sleeve and is slidable between an extended running-in position and a weight set-down position. The setting nut connecting threads are preferably right hand release threads, whereby the setting tool is releasable from the setting sleeve by right hand rotation of the mandrel when the mandrel is in the weight set-down position.

Latch means operably associated with the setting nut and the mandrel prevent relative movement between the connecting threads of the setting nut and the setting sleeve when the mandrel is in the extended running-in position and allow relative movement between the connecting threads when the mandrel is in the weight set-down position to release the connecting threads. Biasing means preload the mandrel in the extended running-in position. At least one torque transmitting spline on the mandrel exterior is received within the setting nut axial groove whereby torque transmitted to the mandrel is transmitted to the setting nut. Premature release control means, preferably at least one shear screw, fixes the mandrel to the setting sleeve for retaining the mandrel in the extended running-in position until a predetermined downward force is applied to the mandrel.

The latch means preferably includes a latch collar having at least one latch car carried on the mandrel exterior. The setting sleeve has at least one end notch adapted to receive the latch ear for preventing relative rotational movement between the connecting threads of the setting nut and the setting sleeve when the marndrel is in the extended running-in position and allowing relative movement between the connecting threads when the mandrel is in the weight set-down position to release the connecting threads. Torque override means are also provided for releasing the latch means upon the application of a predetermined rotational torque to the mandrel to thereby allow relative rotational movement between the connecting threads without the application of downward force to the mandrel. The torque override means can comprise at least one shear screw connecting the latch collar to the mandrel.

In the method of releasing a setting tool utilizing the torque override feature of the invention, the setting tool is first run into the well bore on the end of a pipe string with a setting sleeve disposed about and engaged below the setting tool. The setting sleeve is then manipulated to perform well bore operations by applying right hand torque to the pipe string from the surface. To release the tool, sufficient right hand torque is applied to the pipe string to override the predetermined torque responsive latch means to release the setting tool from the setting sleeve without the application of downward force to the mandrel. The setting tool can then be withdrawn from the well bore.

Additional objects, features and advantages will be apparent in the written description which follows.

BRIEF DESCRIPTION OF THE DRAWINGS

FIG. 3 is a cross-sectional view of the setting tool of FIG. 1B taken along lines III—III.

FIG. 4 is a perspective view of the latch mechanism of the setting tool with parts broken away.

DETAILED DESCRIPTION OF THE INVENTION

Figure 1A:
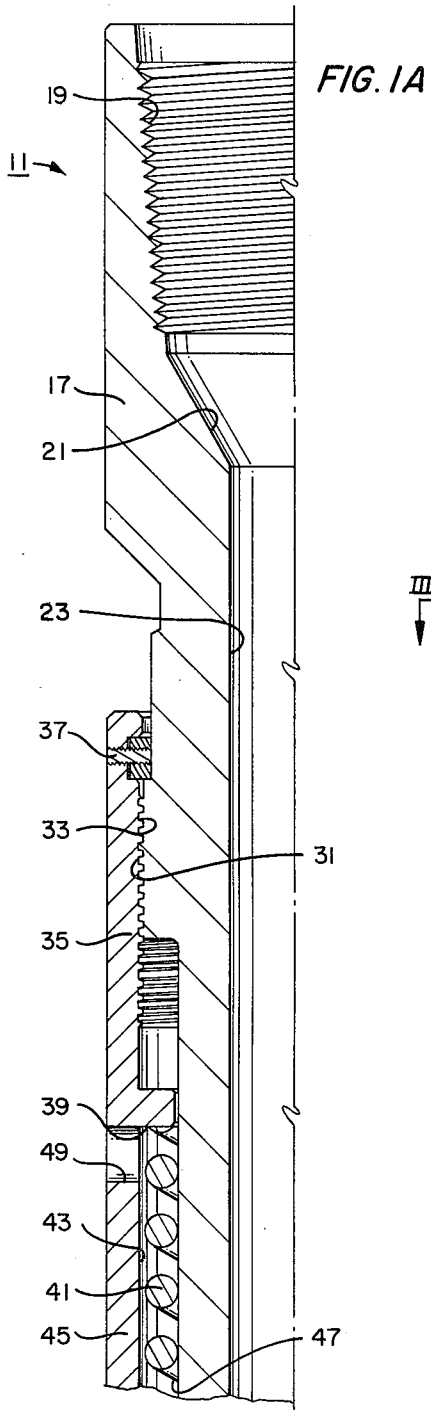
FIG. 1A is a side partial cross-sectional view of the upper end of the setting tool of the invention in the running-in position.

Turning to FIG. 1A, there is shown a setting tool designated generally as 11 of the type adapted to be made up in a pipe string for releasably engaging a setting sleeve 13 (FIG. 1B) in a well bore. By "well bore" is meant the annular space between the setting tool 11 and the casing, it being understood that the well bore could be unlined, as well.

The setting tool 11 includes a tubular mandrel 15 having an upper end 17 which is internally threaded at the upper extent 19 thereof for matingly engaging the external threads of the lower extent of the pipe string (not shown) running to the surface. The internally threaded upper extent 19 of upper end 17 is connected by means of a tapered bore 21 to an internal bore 23 which runs through the remainder of the length of the mandrel to the lower end 25 which has an internally threaded surface 27 adapted to be connected, for example, to a bottom sub 29.

The mandrel upper end 17 has an externally threaded surface 31 which matingly engages the internally threaded surface 33 of a spring retaining sleeve 35. Retaining sleeve 35 is a generally cylindrical member which can be fixedly secured to upper end 17 by means of threads 33 and set screws 37 and has a lower inwardly extending shoulder 39 which forms an upper stop for a coil spring 41 located in an annular space 43 between the lower extent 45 of retaining sleeve 35 and the mandrel exterior 47. Lower extent 45 also includes a port 49 which communicates the exterior well bore with the space 43.

Figure 1B:
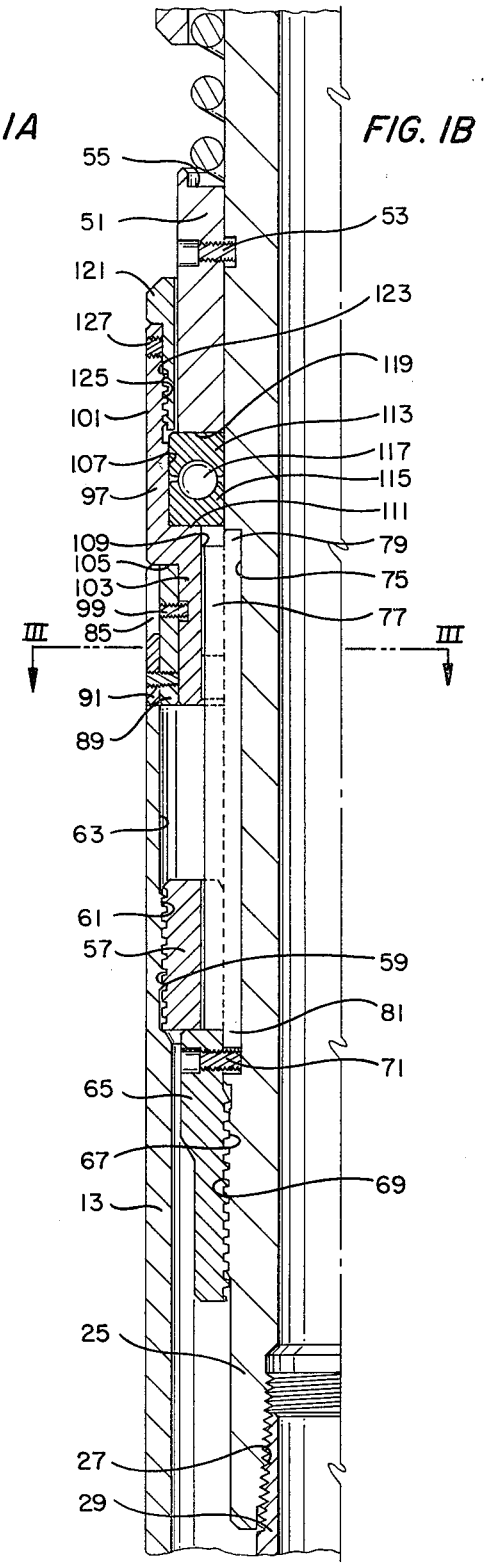
FIG. 1B is a downward continuation of the tool of FIG. 1A showing the running-in position.

A cylindrical lower spring stop 51 is carried about the mandrel exterior 47 by shear screws 53 and has an upper ledge 55 which acts as a lower spring stop for coil spring 41, as shown in FIG. 1B.

The mandrel also has a setting nut 57 which is carried on the mandrel exterior and which has external connecting means such as connecting threads 59 for engaging mating connecting threads 61 located on the interior 63 of the setting sleeve 13 disposed about the lower end 25 of the mandrel 15. As shown in FIG. 1B, the setting nut 57 rides on a retaining nut 65 which is connected by means of threads 67 to the externally threaded surface 69 of the mandrel lower end 25 and fixed in position as by set screws 71. In the running-in position shown in FIGS. 1A and 1B, the weight of the setting sleeve 13 is carried through the setting nut 57 on the retaining nut 65.

Figure 2A:
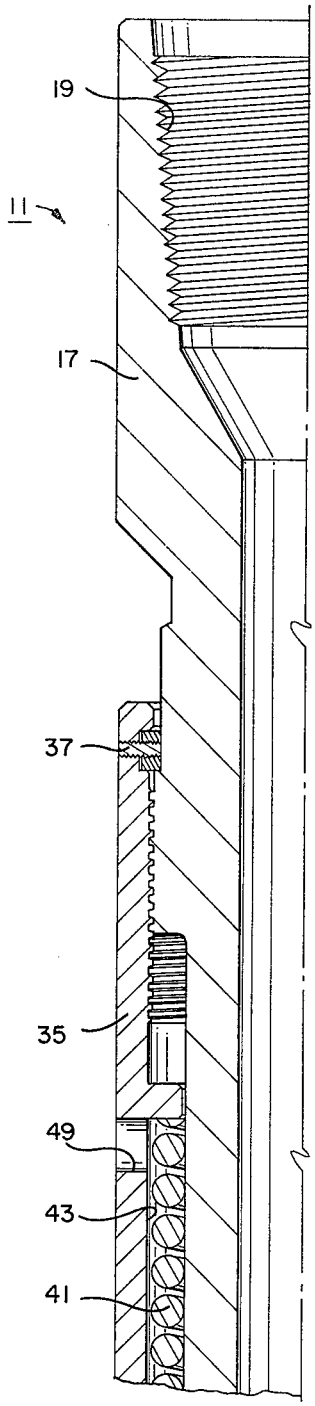
FIG. 2A is a side partial cross-sectional view of the upper end of the setting tool in the weight set-down position.

As shown in FIG. 3, the setting nut 57 has at least one axial groove 73 in the interior thereof. Preferably, the setting nut 57 has four axial grooves located equi-distantly about the internal bore 23 of the tubular mandrel 15. As best seen in FIG. 1B, the mandrel 15 has four axial recesses 75 cut in the exterior surfaces 47 for receiving four matching torque transmitting splines 77. Splines 77 are generally rectangular longitudinal bars each of which has an upper shoulder 79 and a lower shoulder 81 formed at the opposite ends thereof. The rear wall 83 (FIG. 3) of each spline 77 is fitted within the respective axial recess 75 of the mandrel 15. The lower shoulders 81 are retained in position by the upper portion of retaining nut 65 as shown in FIG. 1B. As will be more fully described, the mandrel 15 is slidably disposed within the setting nut 57 when the nut 57 is engaging the setting sleeve 13, the mandrel 15 being slidable between an extended running-in position as shown in FIGS. 1A and 1B, and a weight set-down position as shown in FIGS. 2A and 2B.

Figure 2B:
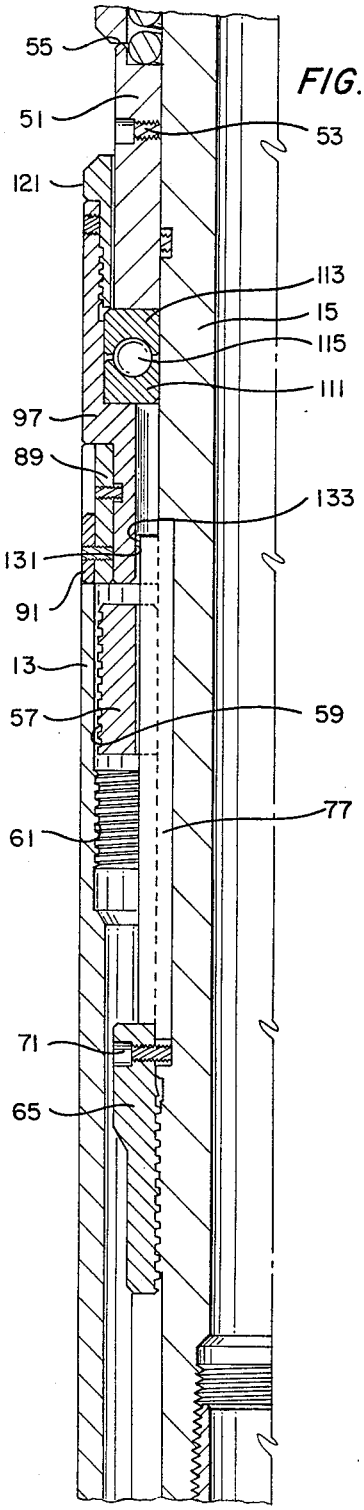
FIG. 2B is a downward continuation of FIG. 2A showing the setting tool in the weight set-down position with the connecting means disconnected.

As shown in FIGS. 1B and 4, the upper end 85 of the setting sleeve 13 is provided with at least one end notch 87 which forms a part of a latch means operably associated with the setting nut 57 and the mandrel 15 for preventing relative movement between the connecting threads 59, 61 of the setting nut 57 and setting sleeve 13 when the mandrel 15 is in the extended running-in position shown in FIG. 1B and allowing relative movement between the connecting threads 59, 61 when the mandrel 15 is in the weight set-down position shown in FIG. 2B. Preferably, four end notches 87 are provided spaced equi-distantly about the upper end 85 of setting sleeve 13.

The latch means further comprises a latch collar 89 which is a generally cylindrical member having four square latch ears 91 (FIG. 4) which are secured to the latch collar 89 by pins 93. Latch ears 91 can also be formed as an integral part of the latch collar 89. The latch ears 91, as shown in FIG. 4, are spaced equi-distantly about the circumference of the lower edge 95 of the latch collar 89 and are arranged in alignment with the end notches 87 of the setting sleeve 13 when the latch means is assembled. The latch collar 89 is releasably secured to a latching sub 97 (FIGS. 1B & 4) by means of shear screws 99. As best seen in FIG. 1B, the end notches 87 are adapted to receive the respective latch ears 91 for preventing relative rotational movement between the connecting threads of the setting nut 57 and the setting sleeve 13 when the mandrel is in the extended running-in position and torque is being transmitted to the setting nut 57 through the mandrel 15 and torque transmitting splines 77.

The latching sub 97, as shown in FIG. 1B, has a generally cylindrical exterior which forms an upper extent 101 of greater relative diameter and a lower extent 103 of lesser relative external diameter on which is received the latch collar 89. The junction of the upper and lower extents 101 and 103 defines a downwardly facing shoulder 105 which contacts the latch collar 89. Latching sub 97 also has an upper region of greater relative internal diameter 107 which is joined to a region of lesser relative internal diameter 109 to form an internal shoulder 111 which is adapted to receive a bearing made up of upper and lower bearing races 113, 115 and a series of balls 117 carried within the races. The lower spring stop 51 of the tool has a lower end 119 which is carried upon the upper bearing race 113.

The bearing is retained in position on the shoulder 111 by means of a gage ring 121 which has an externally threaded end 123 which engages the internally threaded surface 125 of the latching sub 97. The gage ring 121 can be fixed in position, as by screws 127.

As best seen in FIG. 4, the latching sub lower extent 103 is provided with internal axial openings 129 for receiving the torque transmitting splines 77 and for preventing relative movement between the mandrel, setting nut, and setting sleeve when the mandrel and torque transmitting splines are in the extended, running-in position shown in FIG. 1B. As shown in FIG. 4, the lower extent 103 of the latching sub 97 has an internal beveled edge or clearance 131 sized to receive the leading edge 133 of each of the torque transmitting splines when the mandrel 15 is in the weight set-down position as shown in FIG. 2B. The beveled area 131 in the interior of the lower extent 103 of latching sub 97 allows relative movement between the torque transmitting splines 77 and the latching sub 97 when the tool is in the weight set-down position. The latching sub 97 is held in fixed position as shown in FIG. 1B by the latch collar 89, and by the latch ears 91 which are received within the end notches 87 of the setting sleeve 13. Relative movement between the splines 77 and the latching sub 97 now allows torque to be transmitting from the mandrel 15 to the setting nut 57 to break the connection formed by the threads 59, 61, as shown in FIG. 2B. The setting nut connecting threads 59 are preferably right hand release threads, whereby the setting tool 11 is releasable from the setting sleeve 13 by right hand rotation of the mandrel 15 when the mandrel is in the weight set-down position shown in FIG. 2B.

The operation of the present invention will now be described. In a typical liner hanging operation, the setting tool of the invention would be made up in a pipe string by threading the upper end 17 (FIG. 1A) onto the lower extent (not shown) of a pipe string running to the surface. The setting nut 57 would be engaging the setting sleeve 13 by means of the right hand release connecting threads 59, 61. The weight of the liner hanger and liner which is suspended below the setting sleeve 13 would be acting through the setting nut 57 on the retaining nut 65. The mandrel 17 would be spring biased by means of coil spring 41 in the extended running-in position shown in FIGS. 1A and 1B. Shear screws 53 fixing mandrel 15 to setting sleeve 13 through the lower spring stop 51 would retain the mandrel 15 in the extended running-in position until a predetermined downward force is applied to the mandrel through the pipe string from the surface. Thus, in the running-in position shown in FIGS. 1A and 1B, the setting tool 11 and setting sleeve 13 can be run into the well bore and left or right hand torque can be applied from the surface to the pipe string, mandrel 15, splines 77, setting nut 57, and setting sleeve 13 to manipulate hanger mechanism to hang the liner in the well bore.

Once the liner which is carried below the setting sleeve is hung in the conventional manner, as by setting gripping slips located along a portion of the liner hanger, weight is taken off the setting tool 11, allowing weight set-down on the pipe string from the surface. This action causes screws 53 to shear and overcomes the preload in coil spring 41, allowing sliding movement of the mandrel 15 within the setting nut 57 until the spring retaining sleeve 35 contacts the upper ledge 55 of the lower spring stop 51 as shown in FIG. 2B. The port 49 in the spring retaining sleeve 35 allows any trapped well fluids in the space 43 to pass to the outside of the tool during the sliding movement of the mandrel 15. The weight of the pipe string above the setting tool 11 is now carried on the upper ledge 55 of the lower spring stop 51 and the bearing mechanism 111, 113, 115 allows rotational movement of the mandrel 15 with respect to the stationary setting sleeve 13 without a load being imposed upon the connecting threads 59, 61.

As has been discussed, the clearance 131 in the interior of the latching sub 97 (see FIG. 4) allows rotational movement of the splines 77 within the latching sub 97 to allow the setting nut 57 to be unthreaded by applying right hand torque to the mandrel 15. The application of right hand torque from the surface through the pipe string is thus transmitted through the splines 77 and axial grooves 73 to the setting nut 57 to cause relative movement between the setting nut connecting threads 59 and the internal connecting threads 61 of the setting sleeve 13. The application of right hand torque causes the setting nut 57 to travel upward and become disengaged from the connecting threads 61 of the setting sleeve as best seen in FIG. 2B. Once the setting nut has been completely disengaged, the setting tool 11 can be pulled out of the setting sleeve 13 and raised to the well surface.

The setting tool can also be released without the application of weight from the surface by means of the torque override means made up of the shear screws 99 between the latching collar 89 and latching sub 97. Upon the application of a predetermined rotational torque to the mandrel 15, screws 99 are sheared to thereby allow relative rotational movement between the connecting threads 59, 61 without the application or downward force to the mandrel 15 or downward sliding movement of the mandrel 15 with respect to latching sub 97. Shear screws 99 are selectively sized to prevent inadvertent shearing during setting operations, but at the same time, allow rotational release upon the application of sufficient force from the surface.

In using the torque override feature, the setting tool would first be run into the well bore on the end of a pipe string with a setting sleeve disposed about and engaged below the setting tool 11. The setting sleeve 13 would then be manipulated to perform well bore operations by applying right hand torque to the pipe string from the surface, which torque would be transmitted through the splines 77 and connecting nut 57 to the setting sleeve 13. Upon the application of sufficient right hand torque to the pipe string, the predetermined torque responsive latch means 99 would be overriden to release the setting tool 11 from the setting sleeve 13 without the application of a downward force to the mandrel 15. The setting tool 11 could then be withdrawn from the well bore.

An invention has been provided with significant advantages. The setting tool of the present invention can be run into the well bore and allows left or right hand torque to be applied from the surface to the setting sleeve to perform well bore operations without releasing the setting tool from the setting sleeve. By setting weight down on the setting tool, right hand torque can be applied from the surface to disengage the setting tool from the setting sleeve, allowing the setting tool to be withdrawn from the setting sleeve and raised to the surface. The provision of right hand set and right hand release in the same tool removes the possibility of unthreading tool joints in the pipe string during well bore manipulations. The present setting tool design also has the additional safety features of a spring preload to bias the tool toward the extended running-in position and the provision of premature release shear screws which fixed the mandrel with respect to the spring stop and latching sub until sufficient downward force is applied from the surface. The present setting tool also has the added versatility of a torque override feature which allows the setting tool to be released from the setting sleeve by applying sufficient rotational force from the surface without applying downward force. Such a release feature can become important in many cases such as when the well bore is deviated.

While the invention has been shown in only one of its forms, it will be appreciated that it is not thus limited but is susceptible to various changes and modifications without departing from the spirit thereof.

We claim:

1. A setting tool of the type adapted to be made up in a pipe string for releasably engaging a setting sleeve in a well bore, comprising:

a mandrel having an upper end adapted to be connected in the pipe string and having a lower end;

a setting nut carried on said mandrel having external connecting means for engaging mating connecting means located on the interior of a setting sleeve disposed about of said mandrel;

said mandrel being slidably disposed within said setting nut when said setting nut is engaging said setting sleeve, said mandrel being slidable between an extended running-in position and a weight set-down position;

latch means operably associated with said setting nut and said mandrel for preventing relative movement between said connecting means of said setting nut and said setting sleeve when said mandrel is in said extended running-in position and allowing relative movement between said connecting means when said mandrel is in said weight set down position; and biasing means for pre-loading said mandrel in said extended running-in position.

2. A setting tool of the type adapted to be made up in a pipe string for releasably engaging a setting sleeve in a well bore, comprising:

a mandrel having an upper end adapted to be connected in the pipe string and having a lower end;

a setting nut carried on said mandrel having external connecting threads for engaging mating connecting threads located on the interior of a setting sleeve disposed about said mandrel;

said mandrel being slidably disposed within said setting nut when said setting nut is engaging said setting sleeve, said mandrel being slidable between an extended running-in position and a weight set-down position;

latch means operably associated with said setting nut and said mandrel for preventing relative movement between said connecting threads of said setting nut and said setting sleeve when said mandrel is in said extended running-in position and allowing relative movement between said connecting threads when said mandrel is in said weight set-down position to release said connecting threads; and spring biasing means for pre-loading said mandrel in said extended running-in position.

3. A setting tool of the type adapted to be made up in a pipe string for releasably engaging a setting sleeve in a well bore, comprising:

a mandrel having an upper end adapted to be connected in the pipe string and having a lower end;

a setting nut carried on said mandrel having external connecting threads for engaging mating connecting threads located on the interior of a setting sleeve disposed about said mandrel and said setting nut having at least one axial groove in the interior thereof;

said mandrel being slidably disposed within said setting nut when said setting nut is engaging said setting sleeve, said mandrel being slidable between an extended running-in position and a weight set-down position;

latch means operably associated with said setting nut and said mandrel for preventing relative movement between said connecting threads of said setting nut and said setting sleeve when said mandrel is in said extended running-in position and allowing relative movement between said connecting threads when said mandrel is in said weight set-down position to release said connecting means; and at least one torque transmitting spline on said mandrel exterior adapted to be received within said setting nut axial groove whereby torque transmitted to said mandrel is transmitted to said setting nut; and spring biasing means for pre-loading said mandrel in said extended running-in position.

4. A setting tool of the type adapted to be made up in a pipe string for releasably engaging a setting sleeve in a well bore, comprising:

a mandrel having an upper end adapted to be connected in the pipe string and having a lower end;

a setting nut carried on said mandrel having external connecting means for engaging mating connecting means located on the interior of a setting sleeve disposed about said mandrel;

said mandrel being slidably disposed within said setting nut when said setting nut is engaging said setting sleeve, said mandrel being slidable between an extended running-in position and a weight set-down position;

latch means operably associated with said setting nut and said mandrel for preventing relative movement between said connecting means of said setting nut and said setting sleeve when said mandrel is in said extended running-in position and allowing relative movement between said connecting means when said mandrel is in said weight set-down position; and premature release control means for retaining said mandrel in said extended running-in position until a predetermined downward force is applied to said mandrel.

5. A setting tool of the type adapted to be made up in a pipe string for releasably engaging a setting sleeve in a well bore, comprising:

a mandrel having an upper end adapted to be connected in the pipe string and having a lower end;

a setting nut carried on said mandrel having external connecting threads for engaging mating connecting threads located on the interior of a setting sleeve disposed about said mandrel and said setting nut having at least one axial groove in the interior thereof;

said mandrel being slidably disposed within said setting nut when said setting nut is engaging said setting sleeve, said mandrel being slidable between an extended running-in position and a weight set-down position;

latch means operably associated with said setting nut and said mandrel for preventing relative movement between said connecting threads of said setting nut and said setting sleeve when said mandrel is in said extended running-in position and allowing relative movement between said connecting threads when said mandrel is in said weight set-down position to release said connecting means; and at least one torque transmitting spline on said mandrel exterior adapted to be received within said setting nut axial groove whereby torque transmitted to said mandrel is transmitted to said setting nut; and at least one shear screw fixing said mandrel to said setting sleeve for retaining said mandrel in said extended running-in position until a predetermined downward force is applied to said mandrel.

6. The setting tool of claim 5, further comprising:

spring biasing means for pre-loading said mandrel in said extended running-in position.

7. A setting tool of the type adapted to be made up in a pipe string for releasably engaging a setting sleeve in a well bore, comprising:

a mandrel having an upper end adapted to be connected in the pipe string and having a lower end;

a setting nut carried on said mandrel having external connecting means for engaging mating connecting means located on the interior of a setting sleeve disposed about said mandrel;

said mandrel being slidably disposed within said setting nut when said setting nut is engaging said setting sleeve, said mandrel being slidable between an extended running-in position and a weight set-down position;

latch means operably associated with said setting nut and said mandrel for preventing relative rotational movement between said connecting means of said setting nut and said setting sleeve when said mandrel is in said extended running-in position and allowing relative movement between said connecting means when said mandrel is in said weight set-down position; and torque override means for releasing said latch means upon the application of a predetermined rotational torque to said mandrel to thereby allow relative rotational movement between said connecting means without the application of downward force to said mandrel.

8. A setting tool of the type adapted to be made up in a pipe string for releasably engaging a setting sleeve in a well bore, comprising:

a mandrel having an upper end adapted to be connected in the pipe string and having a lower end;

a setting nut carried on said mandrel having external connecting threads for engaging mating connecting threads located on the interior of a setting sleeve disposed about said mandrel and said setting nut having a least one axial groove in the interior thereof;

said mandrel being slidably disposed within said setting nut when said setting nut is engaging said setting sleeve, said mandrel being slidable between an extended running-in position and a weight set-down position;

at least one torque transmitting spline on said mandrel exterior adapted to be received within said setting nut axial groove whereby torque transmitted to said mandrel is transmitted to said setting nut; and a latch collar having at least one latch ear carried on said mandrel exterior, said setting sleeve having at least one end notch adapted to receive said latch ear for preventing relative rotational movement between said connecting threads of said setting nut and said setting sleeve when the mandrel is in said extended running-in position and allowing relative movement between said connecting threads when said mandrel is in said weight set-down position to release said connecting threads.

9. The setting tool of claim 8, further comprising:

torque override means for releasing said latch means upon the application of a predetermined rotational torque to said mandrel to thereby allow relative rotational movement between said connecting threads without the application of downward force to said mandrel.

10. The setting tool of claim 9, wherein said torque override means comprises at least one shear screw connecting said latch collar to said mandrel.

11. The setting tool of claim 10, wherein said setting nut connecting threads are right hand release threads, whereby said setting tool is releasable from said setting sleeve by right hand rotation of said mandrel when said mandrel is in said weight set-down position.

12. A method of releasing a setting tool of the type adapted to be made up in a pipe string in a well bore from a setting sleeve, comprising the steps of:

running the setting tool into the well bore on the end of a pipe string with a setting sleeve disposed about and engaged below said setting tool;

manipulating said setting sleeve to perform well bore operations by applying right hand torque to said pipe string from the surface;

applying sufficient right hand torque to said pipe string to override a predetermined torque responsive latch means to release said setting tool from said setting sleeve without the application of downward force to said mandrel; and withdrawing said setting tool from said well bore.

* * * * *